350-312 SR
10/14/86 XR 4,617,490

United States Patent [19]

Fitzpatrick et al.

[11] Patent Number: 4,617,490

[45] Date of Patent: Oct. 14, 1986

[54] CATHODE RAY TUBE DEVICE WITH IMPROVED COLOR FILTERING SYSTEM

[75] Inventors: Brian J. Fitzpatrick, Ossining; Phyllis M. Harnack, Hastings-on-Hudson, both of N.Y.

[73] Assignee: North American Philips Corporation, New York, N.Y.

[21] Appl. No.: 679,191

[22] Filed: Dec. 7, 1984

[51] Int. Cl.[4] ..... H01J 31/00; H01J 5/16

[52] U.S. Cl. ..... 313/478; 313/112; 350/312

[58] Field of Search ..... 313/474, 478, 110, 371, 313/466; 358/250, 252, 253; 350/311, 312

[56] References Cited

U.S. PATENT DOCUMENTS 4,529,905 7/1985 Ohkoshi et al. ..... 313/44 X
4,538,089 8/1985 Fitzpatrick ..... 313/478

FOREIGN PATENT DOCUMENTS 2098393A 11/1982 United Kingdom ..... 313/478

*Primary Examiner*—David K. Moore
*Assistant Examiner*—K. Wieder
*Attorney, Agent, or Firm*—Norman N. Spain

[57] ABSTRACT

Halos occurring around bright light spots generated by cathode ray tube devices in which the light emitted by the tubes is filtered by filtering solutions are significantly reduced by the addition of cinnamic alcohol and/or cinnamaldehyde to the solution.

11 Claims, 1 Drawing Figure

CATHODE RAY TUBE DEVICE WITH IMPROVED COLOR FILTERING SYSTEM

BACKGROUND OF THE INVENTION

This invention relates to a new and novel CRT device for generating a bright color light spot of the type that is particularly useful for projection color television and information display.

Green light radiation for use in projection color television in general is produced by the electron bombardment of a green luminescent terbium-activated phosphor such as a terbium-activated yttrium oxide or oxysulfide phosphor. The terbium-activated phosphor, when excited by electronic bombardment, produces a large amount of the desired fundamental radiation at 544 nm, but also produces significant amounts of troublesome radiations at 490 nm, 586 nm and 620 nm. It has been proposed to eliminate the undesired radiations by positioning in the path of the green radiation a light beam filtering means comprising a light filtering solution held in place by a container, the portions of which in the path of the green radiation are formed of glass transparent to the green radiation.

Methods of achieving these results which have been proved successful at least in part are described in British Patent Application U.K. 2098393A, Kikuchi et al I.E.E.E. Transactions on Consumer Electronics, Vol. CE-27, No. 3, August 1981, pp. 478–484, copending U.S. application Ser. No. 453,379, filed Dec. 27, 1982, now U.S. Pat. No. 4,547,699 and copending U.S. application Ser. No. 548,065 filed Nov. 2, 1983, now U.S. Pat. No. 4,538,089 both filed by an inventor common to the instant application and both commonly assigned.

It has been found however that because of the mismatch between the indices of refraction of the filtering solution and the glass plates forming the walls of the container through which the filtered radiation passes (which glass plate is hereinafter called the "face plate") a "halo" effect is produced around the projected spot due to reflections at the solution/glass interfaces.

It is found that such an undesired halo effect not only is encountered when filtering solutions are employed for eliminating undesired radiation from cathode ray tube devices employed for generating bright green light spots but also when filtering solutions are employed with cathode ray tubes used for generating bright blue or bright red light spots as described for example in copending U.S. application Ser. No. 600,049, filed Apr. 13, 1984, now U.S. Pat. No. 4,572,984 and copending U.S. application Ser. No. 659,103 filed Oct. 9, 1984 both filed by one of the instant inventors and both commonly assigned. In all these cases the cause of the "halo" effect is the same, the mismatch of the indices of refraction at the solution/glass interface.

BRIEF SUMMARY OF THE INVENTION

A principle object of this invention is to provide a cathode ray tube (CRT) device for generating a bright color light spot in which the radiation from the tube is filtered by means of a filtering solution while suppressing of the "halo" effect around the projected bright spot is significantly reduced.

Other objects of this invention will be apparent from the description that follows.

According to the invention the applicants have found that the "halo" effect may be reduced to a significant extent by raising the index of refraction of the filtering solution closer to that of the glass by the addition of cinnamaldehyde, cinnamic alcohol or mixtures of these compounds to the filtering solution.

It has been found that the addition of these compounds in amounts of from 62% of saturation to saturation results in a significant decrease in the "halo" around the generated bright light spot. Thus these compounds may be added to the filtering solutions employed in the aforementioned patent applications and publications and in all cases produce a significant reduction in the "halo" effect.

DESCRIPTION OF THE PREFERRED EMBODIMENT

Figure 1:
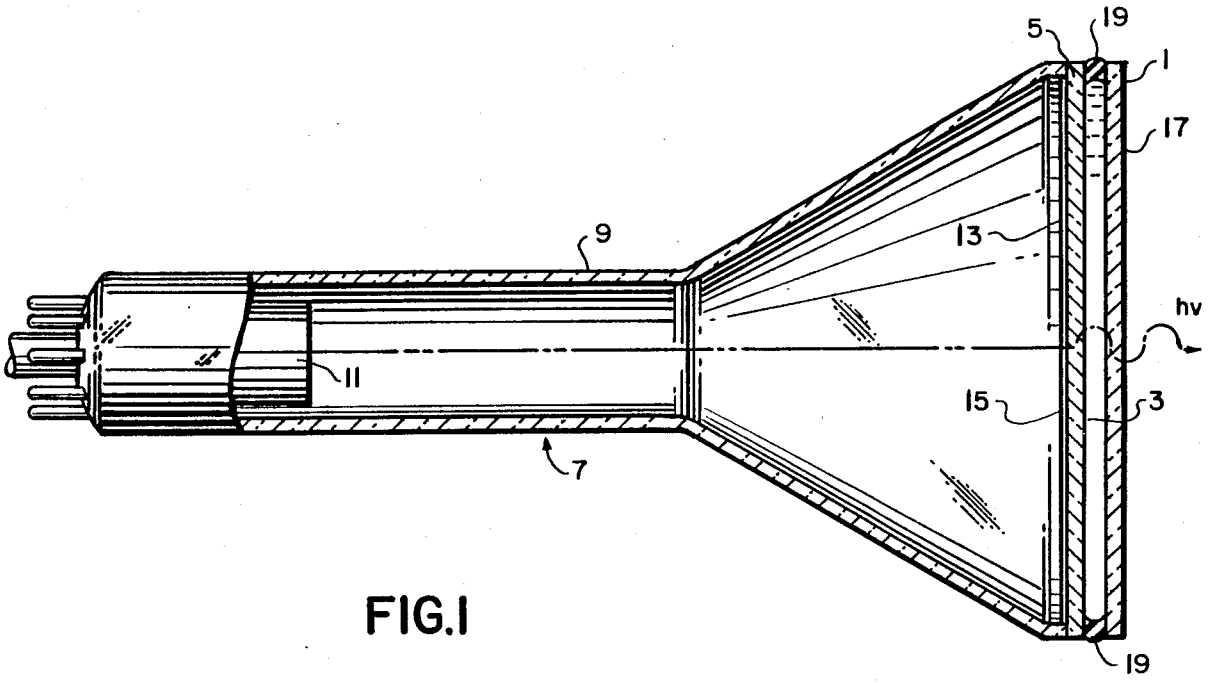
FIG. 1 is a cross-sectional view of a CRT device of the invention.

While the addition of any amount of the cinnamaldehyde or cinnamyl alcohol causes an increase in the index of refraction of the solution and thus tends to suppress the "halo" effect it is found that the most improved results are obtained when the cinnamic alcohol or cinnamaldehyde is employed within the range of 62% of saturation to saturation. As the solvent for the filtering solutions a combination of water and an aliphatic alcohol may be employed. Examples of such alcohols are ethylene glycol, 1,2-propanediol, 1,3-propanediol, glycerol, ethanol, propanol, isopropanol and methanol. Preferably from 20% to 80% of the weight of the solvent consists of the alcohol. In that case the solution not only acts as a filtering medium but is an excellent coolant for the tube during operation while rendering the tube resistant to freezing during storage. Optimum results are achieved when the solvent contains about 50% by weight of the alcohol.

Among the bright light generating cathode ray tube devices in which this invention may be employed are the green light generating cathode tube device described in the above-mentioned U.S. application Ser. No. 453,379 wherein a terbium-activated phosphor is employed and the resultant green radiation is filtered by means of a concentrated solution of praseodymium salt; the green light cathode ray tube device described in the above-mentioned U.S. application Ser. No. 548,065 wherein the phosphor employed is a terbium activated phosphor and in the radiation filtering device, a solution of a soluble praseodymium salt, sodium fluorescein and Fast Green FCF is employed; the blue light cathode ray tube generating device described in the above-mentioned U.S. application Ser. No. 600,049 wherein a silver activated zinc sulfide phosphor is employed along with a filtering solution comprising a concentrated solution of a soluble erbium salt and methyl violet as well as the red light generating cathode ray tube device described in the U.S. application Ser. No. 659,103 employing a europium-activated phosphor and a concentrated solution of a soluble holmium salt and a soluble neodymium salt as a filtering solution.

Examples of the praseodymium salts that may be employed are praseodymium acetate, praseodymium chloride, praseodymium bromide, praseodymium iodide and praseodymium nitrate, preferably in concentrations of about 6%–13% by weight.

Preferably sodium fluorescein is used in concentrations of 0.008–0.012% and the Fast Green FCF is preferably used in concentrations of from 0.00005% to 0.0012%.

Examples of the erbium salts that may be employed are erbium chloride, erbium bromide, erbium iodide and erbium nitrate preferably in a concentration from 20–40% by weight while the preferred concentration of the Methyl Violet 2B is 0.0004–0.0008% by weight.

Examples of the holmium salts that may be employed are the holmium chloride, iodide and nitrate. Examples of the neodymium salts that may be employed are the neodymium bromide, chloride, iodide and nitrate. Preferably about 40–75 grams of the holmium salt, 40–75 ms of the neodymium salt per 100 ml of solvent are used with the total concentration of the holmium and the neodymium salt preferably not exceeding 120 grams per 100 ml of solvent.

If the filtering solution is to function not only to suppress the undesired radiations but also as the coolant for the tube the solution is preferably carried on the external surface of the tube face plate and is held in place by a glass plate sealed to the outer surface of the face plate. However if no coolant effect is required the solution need not be carried directly on the face plate of the tube but may be carried in a container located outside the external surface of the face plate of the tube as long as the container is in the path of the radiation emitting from the tube and is transparent to the radiation of the tube.

Preferably, the index of refraction of the filtering solution container, particularly of those portions in the path of the radiation emitting from the CRT, should match that of the face plate of the tube.

For a more complete understanding of the invention, the invention will now be described in greater detail with reference to FIG. 1 of the drawing which is a cross-sectional view of a preferred embodiment of the CRT device of the invention.

A solution of 4 milligrams of Na-fluorescein, 1.4 g of $Pr(NO_3)_3$ and 0.02 mg of Fast Green FCF in 25 ml of a 50% water-50% ethylene glycol solvent is prepared. To 1 ml of this solution there is added 1.7 ml of cinnamic alcohol and an additional 0.8 ml of ethylene glycol to insure complete miscibility. A 5 mm thick layer 1 of the resulting light filtering solution is applied to the external surface 3 of the glass face plate 5 of a cathode ray tube supplied with envelope 9 and containing an electron gun 11 positioned to emit a beam of electrons and cause this beam of electrons to impinge on the surface of a green luminescent screen 13 formed of terbium-activated yttrium oxysulfide (P45) phosphor deposited on the internal surface of the face plate 5. The solution layer 1 is held in place on the external surface of the face plate 5 by transparent glass end plate 17 and seals 19. The face plate 5 and the transparent end plate 17 are made of glass having an index of refraction of $n_D=1.51$. The index of refraction of the layer 1 of the light filtering solution is 1.4933. Practically no "halo" is noted around the projected green light spot produced by this device.

The substitution of a filtering solution identical with that employed in the device of the invention except for the elimination of the cinnamic alcohol results in the production of a green light spot in which a highly visible "halo" is noted around the projected green light spot. In this case the index of refraction of the solution layer is found to be 1.4230.

Although the present invention has been described with reference to particular embodiments thereof, it will be understood that numerous modifications can be made by those skilled in the art without actually departing from the scope of the invention.

What we claim is:

1. A cathode-ray tube device for generating a bright light spot comprising:

a cathode-ray tube including an evacuated envelope, means located within said envelope to generate an electron beam, a phosphor capable of emitting visible light radiation when excited by electrons, positioned within said envelope and in the path of said electron beam, and a transparent face plate forming part of said envelope and situated in the path of said visible light radiation and, positioned outside of the outer surface of said face plate and in the path of said visible light radiation, a light beam filtering means comprising, in a container which at least in the path of said light radiation, is transparent to said radiation and which comprises as a visible light radiation exit member a glass end plate, a light filtering solution containing in addition to light filtering ingredients, as index of refraction raising ingredients, a compound selected from the group consisting of cinnamic alcohol and cinnamaldehyde and mixtures thereof in an amount sufficient to form a concentrated solution thereof.

2. The cathode ray tube device of claim 1, wherein a solvent of the solution is a mixture of water and an alcohol selected from the group consisting of 1,2-ethylene glycol, 1,2-propanediol, glycerol, ethanol, propanol, isopropanol and methanol.

3. The cathode ray tube device of claim 2 wherein the visible light radiation is green light radiation, the bright light spot is a bright green light spot, the phosphor is a terbium activated phosphor capable of emitting visible green radiation when excited by electrons and the light filtering solution contains as a light filtering ingredient a praseodymium salt.

4. The cathode ray tube device of claim 3 wherein the solvent is a mixture of water of up to 80% by weight of ethylene glycol.

5. The cathode ray tube device of claim 4 wherein in addition to the praseodymium salt, sodium fluorescein and Fast Green FCF are present in the light filtering solution as light filtering ingredients.

6. The cathode ray tube device of claim 4 wherein the light beam filtering means is sealed to the outer surface of the face plate.

7. The cathode ray tube device of claim 5 wherein the light beam filtering means is sealed to the outer surface of the face plate.

8. The cathode ray tube device of claim 2 wherein the visible light radiation is blue light radiation, the phosphor is a silver activated zinc sulfide phosphor and a soluble erbium salt and methyl violet are present in the light filtering solution as light filtering ingredients.

9. The cathode ray tube device of claim 8 wherein the light beam filtering means is sealed to the outer surface of the face plate.

10. The cathode ray tube device of claim 2 wherein the visible light radiation is red light radiation, the phosphor is an erbium activated phosphor and a holmium salt and a neodymium salt are present in the light filtering solution as light filtering ingredients.

11. The cathode ray tube device of claim 10 wherein the light beam filtering means is sealed to the outer surface of the face.

* * * * *

UNITED STATES PATENT AND TRADEMARK OFFICE

CERTIFICATE OF CORRECTION

PATENT NO. : 4,617,490

DATED : October 14, 1986

INVENTOR(S) : BRIAN J. FITZPATRICK ET AL

It is certified that error appears in the above-identified patent and that said Letters Patent is hereby corrected as shown below:

In the Claims:

Column 4, line 20, change "plate," to --plate and--.

Column 4, line 67, after "face" insert --plate--.

Signed and Sealed this

Twenty-fourth Day of November, 1987

*Attest:*

DONALD J. QUIGG

*Attesting Officer*

*Commissioner of Patents and Trademarks*